United States Patent [19]

Brazell et al.

[11] Patent Number: 5,009,221

[45] Date of Patent: Apr. 23, 1991

[54] ADJUSTABLE LINTEL EXTENSION FOR A FIREPLACE

[75] Inventors: David O. Brazell; J. Timothy French, both of Yorba Linda, Calif.

[73] Assignee: Superior Fireplace Company, Fullerton, Calif.

[21] Appl. No.: 467,647

[22] Filed: Jan. 19, 1990

[51] Int. Cl.[5] ..... F24B 1/189

[52] U.S. Cl. ..... 126/538; 126/286

[58] Field of Search ..... 126/536–539, 126/285 R, 286, 287, 289, 290, 292, 291, 312

[56] References Cited

U.S. PATENT DOCUMENTS

| | | | |
|---|---|---|---|
| 385,923 | 7/1888 | Fenner | 126/296 |
| 390,119 | 9/1888 | Evans | 126/296 |
| 393,313 | 11/1888 | Romang | 126/296 |
| 605,713 | 6/1898 | Heitland | 126/538 |
| 2,684,647 | 7/1954 | Bither | 126/296 |
| 4,117,827 | 10/1978 | Billmeyer | 126/538 |
| 4,305,378 | 12/1981 | Driesmans | 126/538 |
| 4,509,498 | 4/1985 | England et al. | 126/539 |

FOREIGN PATENT DOCUMENTS

| | | | |
|---|---|---|---|
| 14795 | of 1911 | United Kingdom | 126/539 |
| 367040 | 2/1932 | United Kingdom | 126/539 |

*Primary Examiner*—James C. Yeung

*Attorney, Agent, or Firm*—Christie, Parker & Hale

[57] ABSTRACT

A pre-built fireplace has a housing with an outlet for combustion gases and an open front for viewing the inside of the fireplace. A hinged damper and a hinged lintel extension are suspended from the inside of the fireplace. The damper and lintel extension are pivotally secured to each other so that when the damper is open, the lintel extension is in place to deflect combustion gases, and when the damper is closed, the lintel extension is pivoted substantially out of view.

7 Claims, 3 Drawing Sheets

ADJUSTABLE LINTEL EXTENSION FOR A FIREPLACE

FIELD OF THE INVENTION

This invention relates to fireplaces, and more particularly, to factory-built fireplaces having movable lintel extensions

BACKGROUND OF THE INVENTION

It is common practice to install "zero clearance" or "factory-built" fireplaces in building structures due to their relatively low cost and simple installation procedures. Conventional factory-built fireplaces have a firebox with an exhaust outlet, and a front opening for viewing the inside of the firebox. A built-in damper is included to cover the outlet when the fireplace is not in use. Typical factory-built fireplaces also include a panel called a lintel extension across the front, and along the top portion of the firebox opening. The lintel extension inhibits smoke from spilling out of the top of the firebox opening while the firebox is in use. However, the lintel extension conventionally remains in place even when the firebox is not in use, thus significantly impairing the view of the firebox.

SUMMARY OF THE INVENTION

The present invention provides a factory-built fireplace having a housing that generally defines a firebox area. The housing has an outlet for combustion gases and an open forward side for viewing the firebox area. A damper is pivotally coupled to the housing so that it can be moved away from the outlet while in its operative position, and pivoted back to cover the outlet while in its inoperative position. A lintel extension is pivotally secured within the housing in proximity to the open forward side of the housing such that the lintel extension depends from the top of the housing into a portion of the open forward side while in its operative position. The lintel extension is pivoted away from the open forward side of the housing while in its inoperative position. A linkage is pivotally coupled to both the damper and the lintel extension to coordinate the movement of both the damper and the lintel extension to and from their operative and inoperative positions.

BRIEF DESCRIPTION OF THE DRAWINGS

These and other features and advantages of the present invention will be better understood by reference to the following detailed description when considered in conjunction with the accompanying drawings wherein.

DETAILED DESCRIPTION

Figure 1:
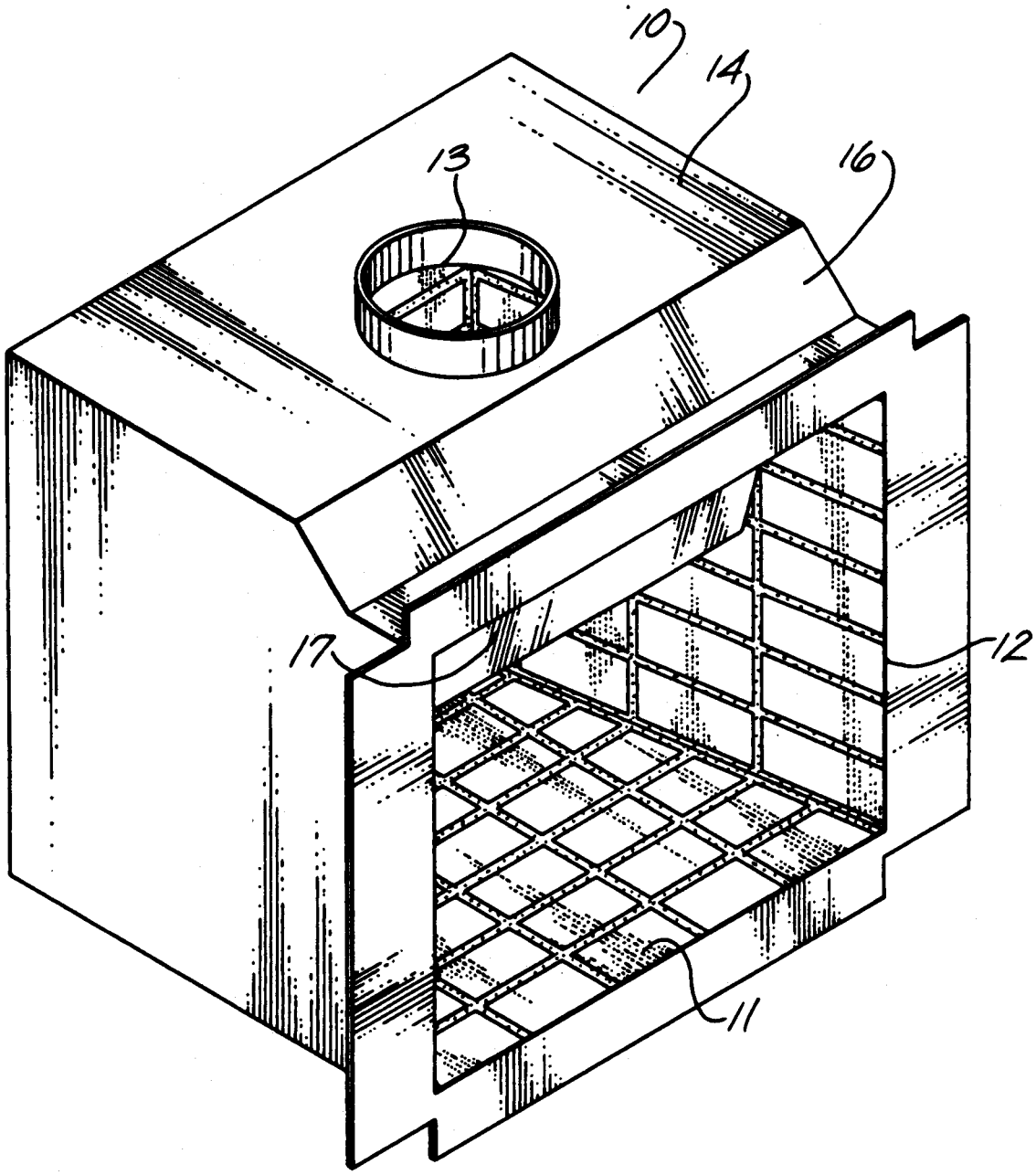
FIG. 1 is a pictorial view of a pre-built fireplace.

Referring to FIG. 1 an exemplary factory-built fireplace is shown having a housing 10 which generally defines a firebox area 11. The firebox area is that area in which the fire burns. Housing 10 has an open front side 12 for viewing the firebox area and an exhaust outlet 13 disposed in a top panel 14 of the housing. In an exemplary embodiment of the present invention, the top of housing 10 is substantially horizontal in the area where exhaust outlet 13 is disposed, and it has a substantially slanted portion 16 wherein the housing slants downwardly and forwardly A lintel extension 17 is suspended from the upper portion of the firebox area.

Figure 2:
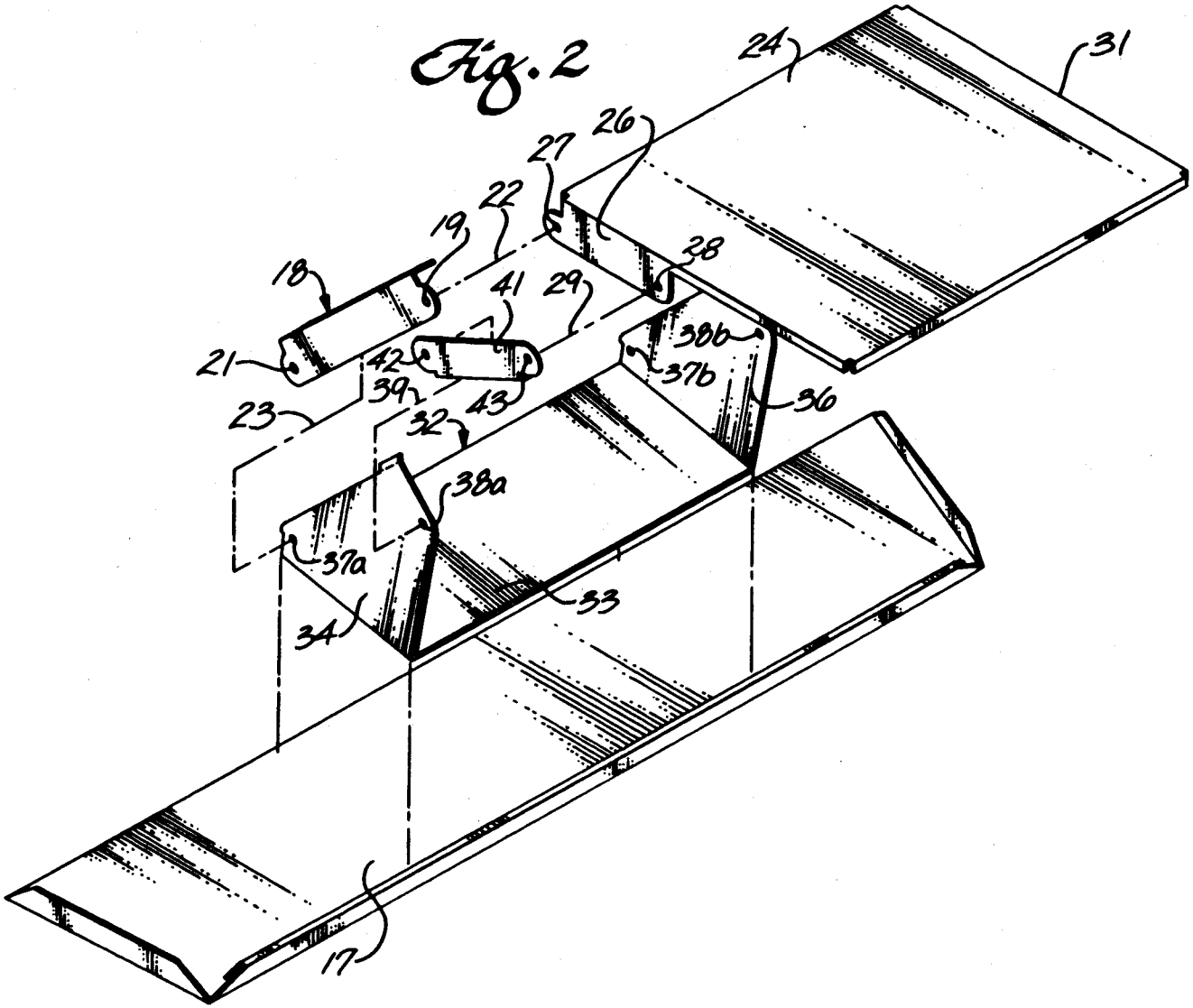
FIG. 2 is a exploded view, shown in elevation, of the present invention.

As best seen in FIG. 2, a first L-shaped mounting bracket 18 is connected to the inside of the housing. In an exemplary embodiment, the first mounting bracket is mounted on the underside of the slanted portion of the housing. The first mounting bracket has a mounting flange 20 having first and second holes 19 and 21 aligned respectively with first and second horizontal axes 22 and 23.

A damper 24 has a first depending flange 26 having a first hole 27 aligned with first horizontal axis 22 and a second hole 28 aligned with a third horizontal axis 29. The damper is pivotally secured to the first mounting bracket along the first horizontal axis.

The damper has a second depending flange (not shown) opposite the first depending flange, the second flange depending from the opposite side 31 of damper 24. The second depending flange has two holes being substantially aligned with first horizontal axis 22 and third horizontal axis 29 respectively. The second depending flange of the damper is pivotally secured to a second L-shaped mounting bracket (not shown) substantially along the first horizontal axis.

A lintel extension bracket 32 has a rectangular shaped face 33, a first perpendicular flange 34 and a second perpendicular flange 36. The first perpendicular flange has a first hole 37*a* aligned with second horizontal axis 23 and a second hole 38*a* aligned with a fourth horizontal axis 39. The second perpendicular flange has a first hole 37*b* substantially aligned with the second horizontal axis and a second hole 38*b* substantially aligned with the fourth horizontal axis. The first perpendicular flange is pivotally secured to first mounting bracket 18 along the second horizontal axis. The second perpendicular flange is pivotally secured to the second mounting bracket substantially along the second horizontal axis.

A first control link 41 having a first hole 42 aligned with fourth horizontal axis 39 and a second hole 43 aligned with third horizontal axis 29 is pivotally secured to first depending flange 26 of the damper along the third horizontal axis. The first control link is also pivotally secured to first perpendicular flange 34 of lintel extension bracket 32 along the fourth horizontal axis. A second control link (not shown) has first and second holes substantially aligned with the third and fourth horizontal axes respectively The second control link is pivotally secured to the second depending flange of the damper substantially along the third horizontal axis, and it is pivotally secured to second perpendicular flange 36 of lintel extension bracket 32 substantially along the fourth horizontal axis.

Rectangular face 33 of lintel extension bracket 32 is fixedly attached to lintel extension 17.

Figure 3:
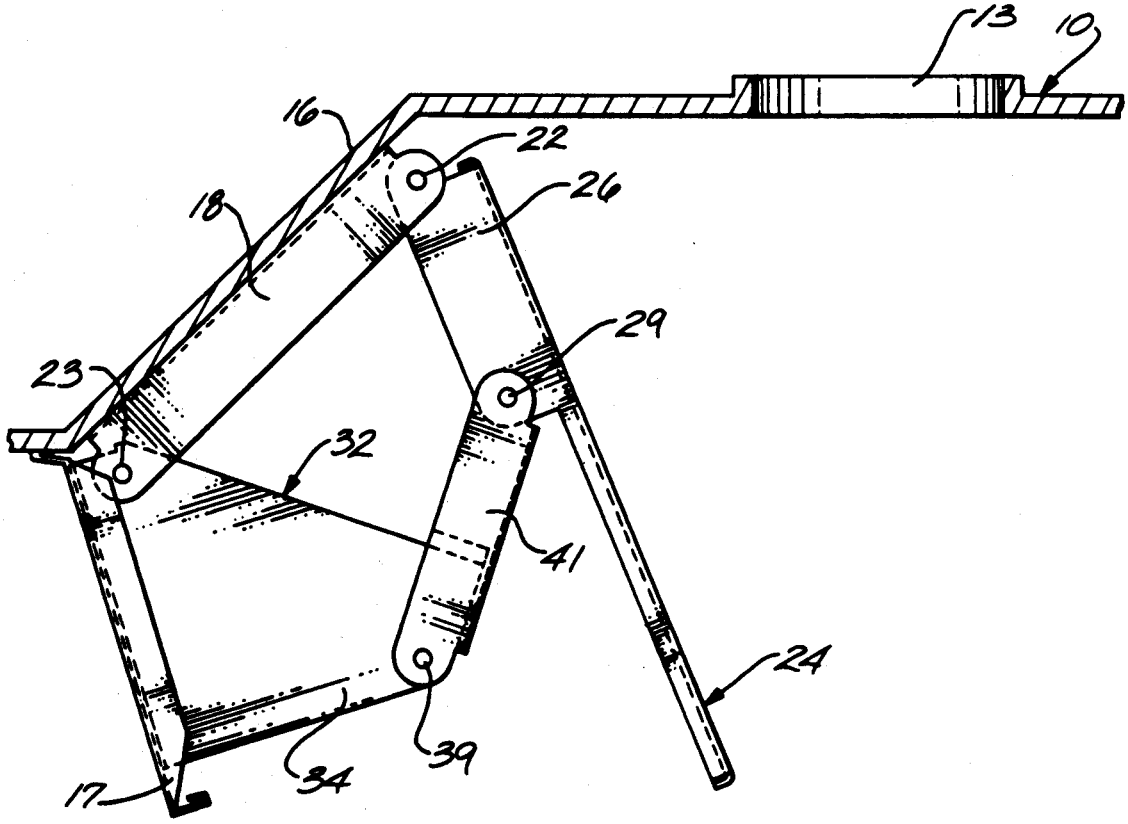
FIGS. 3 and 4 are side views of the present invention in operation.
Figure 4:
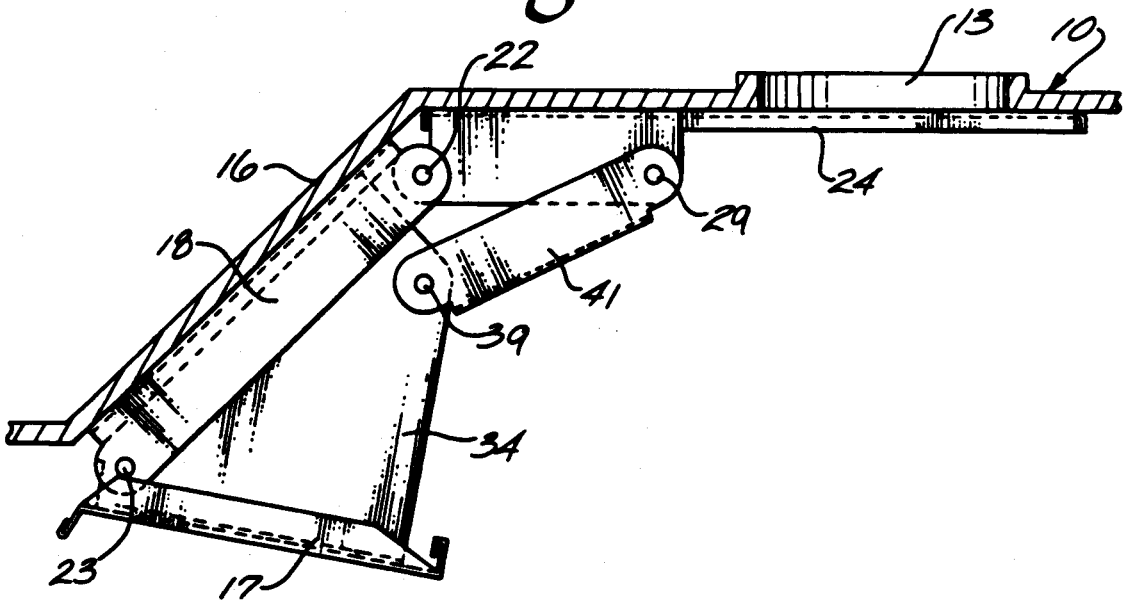

Referring to FIGS. 3 and 4, an exemplary embodiment of the present invention is shown in relation to firebox housing 10. First mounting bracket 18 is fixedly attached to slanted portion 16 of housing 10. In FIG. 3, the damper and lintel extension are shown in their operative positions Note that the damper and lintel extension depend into the firebox area and that combustion gases from the firebox area are free to escape through exhaust outlet 13. In FIG. 4, the damper and lintel extension are shown in their inoperative positions. The damper covers the exhaust outlet, and the lintel extension has pivoted to a substantially horizontal position. Because of the coupling of the damper and the lintel extension with the control links (only first control link 41 being shown in the drawings), the damper and lintel extension must always move together between their respective operative and inoperative positions.

The damper and lintel extension are moved between the above described positions using conventional methods and apparatus. For example, in one embodiment of the present invention, a handle is attached to the damper or the lintel extension to enable the user of the invention to reach into the fireplace and operate the apparatus. In an alternate embodiment, a lever which projects outside of the fireplace and which is coupled to the damper or lintel extension in a conventional manner is used to control the position of the apparatus.

The preceding description has been presented with reference to the presently preferred embodiment to the invention shown in the drawings. Workers skilled in the art and technology to which this invention pertains will appreciate that alterations and changes in the described structures can be practiced without departing from the spirit, principles and scope of this invention.

Accordingly, the foregoing description should not be read as pertaining only to the precise structure described, but rather should be read consistent with, and as support for, the following claims which are to have their fullest fair scope.

What is claimed is:

1. A pre-built fireplace comprising:

a frame having an outlet for combustion gases and an open front side for viewing the interior of the frame;

a damper movably secured to the frame between a first position allowing combustion gases to escape from the frame through the outlet and a second position substantially inhibiting the escape of gases through the outlet; and a lintel extension movably secured to the frame and movably coupled to the damper such that movement of the damper to the first position simultaneously moves the lintel extension partially into the viewing area of the frame to inhibit the escape of combustion gases from the open front side and movement of the damper to the second position simultaneously moves the lintel extension to a position substantially out of the viewing area of the frame.

2. A pre-built fireplace as recited in claim 1 further comprising a rigid control link pivotally secured to both the damper and lintel extension for the simultaneous movement of the damper and lintel extension.

3. A pre-built fireplace as recited in claim 1 further comprising means for pivotally securing the damper to the frame.

4. A pre-built fireplace as recited in claim 1 further comprising means for pivotally securing the lintel extension to the frame.

5. A smoke deflection apparatus for use in a fireplace comprising:

a movable damper pivotally connectable to a fireplace for allowing combustion gases to escape from the fireplace while the damper is in its operative position and for blocking the escape of gases while in its inoperative position;

a movable lintel extension pivotally connectable the fireplace, the lintel extension depending partially down into the open forward side of the frame while in its operative position and rotatable to a substantially horizontal position while in its inoperative position; and a linkage pivotally coupled to both the damper and the lintel extension for simultaneous movement of the damper and lintel extension between their respective operative and inoperative positions.

6. A pre-built fireplace comprising:

a housing defining a firebox area having an outlet for combustion gases and an open forward side for viewing the firebox area;

a movable damper pivotally coupled to the housing for allowing combustion gases to escape through the outlet while the damper is in its operative position and for covering the outlet while in its inoperative position;

a movable lintel extension pivotally coupled to the housing, the lintel extension depending partially down into the open forward side of the frame while in its operative position and rotatable upwardly and rearwardly while in its inoperative position; and a linkage pivotally coupled to both the damper and the lintel extension for simultaneous movement of the damper and lintel extension between their respective operative and inoperative positions.

7. A pre-built fireplace comprising:

a frame defining a firebox area having an open forward side and an outlet disposed in the top side of the frame;

first and second elongate mounting brackets fixedly connected to the top side of the frame within the firebox area, each mounting bracket positioned substantially perpendicular to the open forward side of the frame;

a damper, substantially large enough to cover the outlet, pivotally connected to the rearward end of each of the first and second mounting brackets;

a lintel extension bracket pivotally connected to the forward end of each of the mounting brackets;

a lintel extension fixedly secured to the lintel extension bracket; and a first and second control link, each link being pivotally secured to both the damper and the lintel extension bracket.

* * * * *